US008495835B2

(12) United States Patent
Timmons

(10) Patent No.: US 8,495,835 B2
(45) Date of Patent: Jul. 30, 2013

(54) THROUGH DOOR ARM ACCESS PORTHOLE ASSEMBLY

(76) Inventor: Chris Timmons, Airdrie (CA)

( * ) Notice: Subject to any disclaimer, the term of this patent is extended or adjusted under 35 U.S.C. 154(b) by 203 days.

(21) Appl. No.: 12/958,641

(22) Filed: Dec. 2, 2010

(65) Prior Publication Data

US 2012/0137586 A1 Jun. 7, 2012

(51) Int. Cl.
*E06B 7/28* (2006.01)

(52) U.S. Cl.
USPC ..... 49/171; 160/180

(58) Field of Classification Search
USPC ..... 49/163, 169, 171; 160/180
See application file for complete search history.

(56) References Cited

U.S. PATENT DOCUMENTS

| | | | | | |
|---|---|---|---|---|---|
| 1,088,300 | A | * | 2/1914 | Schidorsky | 49/171 |
| 1,715,154 | A | * | 5/1929 | Walsh | 49/171 |
| 2,016,862 | A | * | 10/1935 | Kniesner | 49/171 |
| 2,124,525 | A | * | 7/1938 | Frankel | 49/171 |
| 2,699,826 | A | | 1/1955 | Emerson | |
| 2,708,927 | A | * | 5/1955 | Dixon et al. | 600/22 |
| 2,832,406 | A | * | 4/1958 | Turenne | 160/179 |
| 3,826,300 | A | | 7/1974 | Lee | |
| 4,022,263 | A | * | 5/1977 | Beckett et al. | 160/92 |
| 4,331,254 | A | | 5/1982 | Haggerty | |
| 4,350,198 | A | | 9/1982 | Naegeli | |
| 4,407,234 | A | * | 10/1983 | Kleman | 119/672 |
| 4,885,000 | A | | 12/1989 | Hogan | |
| 4,932,454 | A | * | 6/1990 | Swope | 160/105 |
| 4,938,169 | A | * | 7/1990 | Barmakian | 119/622 |
| 6,338,315 | B1 | * | 1/2002 | Stillman | 119/51.01 |
| 6,634,407 | B1 | | 10/2003 | Strohmeyer | |
| 2005/0263523 | A1 | | 12/2005 | Moss | |

* cited by examiner

*Primary Examiner* — Jerry Redman
(74) *Attorney, Agent, or Firm* — Maxey Law Office, PLLC; Stephen Lewellyn

(57) ABSTRACT

A through-door arm access porthole assembly includes a first porthole member securely mounted upon an exterior side of a door. The first porthole member is a rigid plate having a front side, a back side, an opening disposed therethrough, and further having a tubular portion aligned with the opening and extending from the back side. The tubular portion extending through the door from the exterior side to an interior side thereof. A second porthole member is securely mounted upon exterior surface of the door. The second porthole member is a rigid plate having a front side, a back side, and further having an opening disposed therethrough. The first porthole member and the second porthole member are fastened together with fasteners with the opening of the first porthole member and the open of the second porthole member in alignment. A seal member is disposed across the opening of the first porthole member and across the opening of the second porthole member and includes a plurality of resilient flap members.

6 Claims, 3 Drawing Sheets

THROUGH DOOR ARM ACCESS PORTHOLE ASSEMBLY

FIELD OF THE INVENTION

The present invention relates generally to portholes, and more particularly, relating to a new through-door arm access porthole assembly for allowing a user to safely pass a gas detecting device through a door from an exterior side thereof to sample the ambient air on the opposite side of the door without being exposed to the ambient air.

BACKGROUND OF THE INVENTION

At natural gas plants or other facilities where hazardous gases may become released into the ambient air, such as for example, within a closed environment or room, the ambient air within the room must tested for the presence of hazardous gases to determine if an unsafe work environment exists for works within the room. Heretofore, an operator would simply open a door to the room and pass a gas detecting device through the doorway and into the room to take a measurement or test the ambient air within the room. This is undesirable because it potentially exposes the operator to hazardous gases that may be contained in the room. An exposure to hazardous gases can cause injury or death to the operator.

SUMMARY OF THE INVENTION

The present invention provides a new through-door arm access porthole assembly for permitting an operator to insert a gas detection device through a closed door from an exterior side of the door to test or measure the ambient air on the opposite side of the door for the presence of harmful levels of hazardous gases to minimize exposure to the operator.

In general, in one aspect, a through-door arm access porthole assembly is provided. The assembly includes a first porthole member securely mounted upon an exterior side of a door. The first porthole member is a rigid plate having a front side, a back side, an opening disposed therethrough, and further having a tubular portion aligned with the opening and extending from the back side. The tubular portion extends through the door from the exterior side to an interior side thereof. A second porthole member is securely mounted upon the exterior surface of the door. The second porthole member is a rigid plate having a front side, a back side, and further having an opening disposed therethrough. The first porthole member and the second porthole member are fastened together with fasteners with the opening of the first porthole member and the open of the second porthole member in alignment. A seal member is disposed across the opening of the first porthole member and across the opening of the second porthole member and includes a plurality of resilient flap members.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
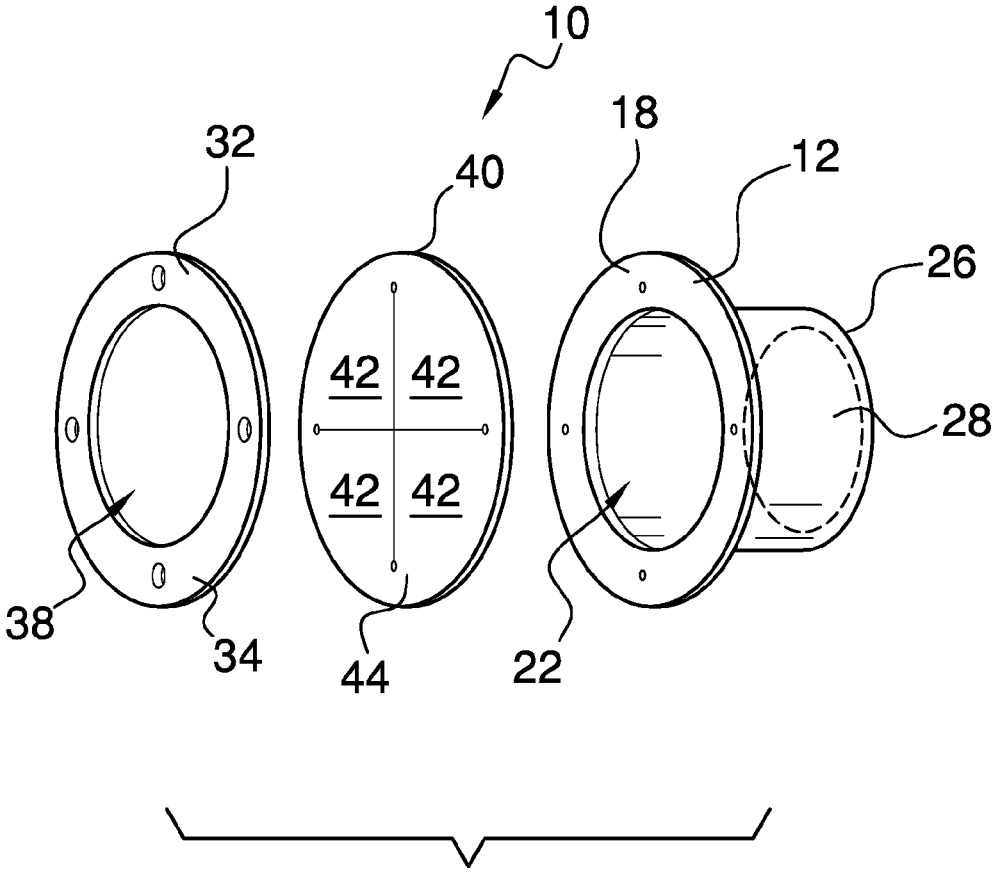
FIG. 1 is a perspective exploded view of a through-door arm access porthole assembly constructed in accordance with the principles of the present invention.
Figure 2:
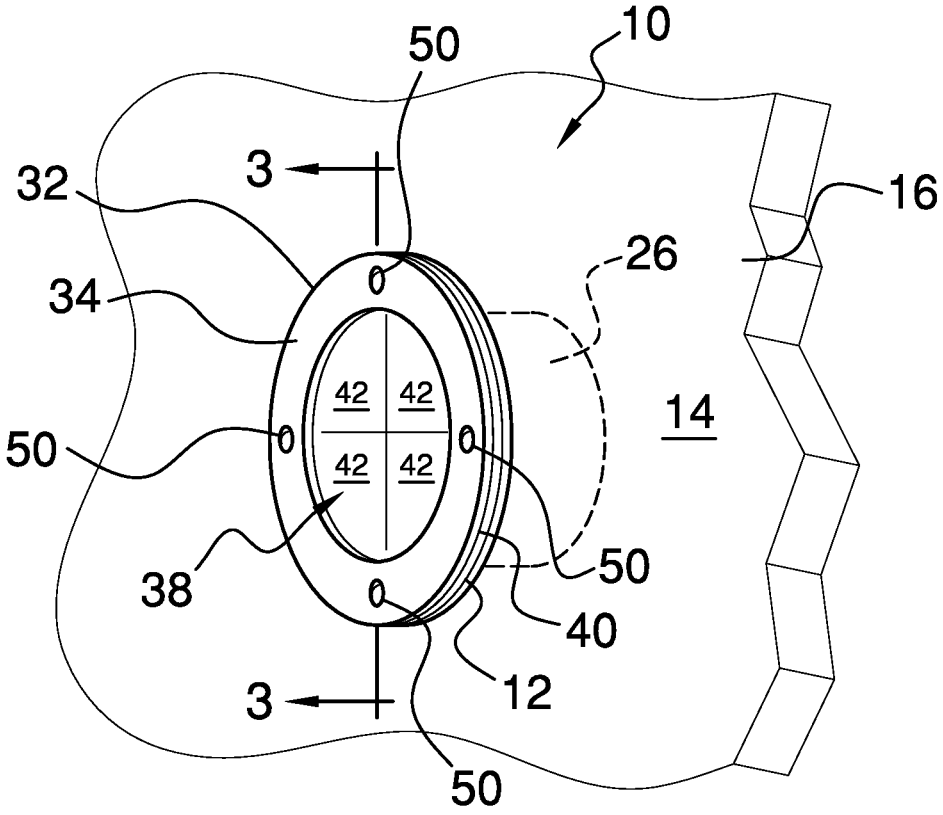
FIG. 2 is a perspective view of the through-door arm access porthole assembly and a door.
Figure 3:
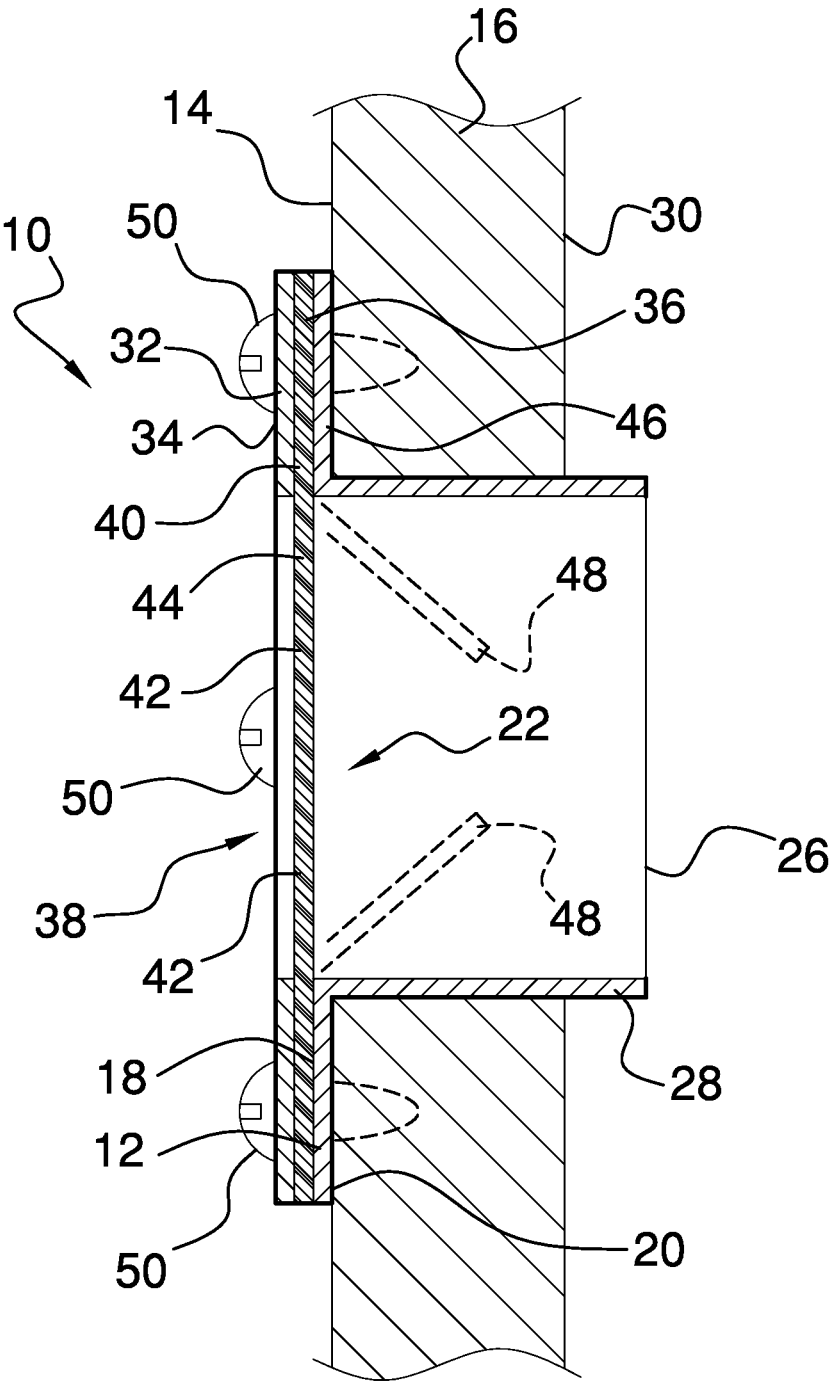
FIG. 3 is a cross-sectional view the through-door arm access porthole assembly and door taken along line 3-3 in FIG. 2.

Referring now to FIGS. 1 through 3 of the drawings, reference numeral 10 generally designates a new through-door arm access porthole assembly, for inserting a gas detection device through a door from an exterior side thereof to sample the ambient air on the opposite side of the door, that is constructed in accordance with the principals of the present invention.

The through-door arm access porthole assembly 10 comprises a first porthole member 12 configured to be securely mounted upon an exterior side 14 of a door 16. The first porthole member 12 is a rigid plate having a front side 18, a back side 20 and an opening 22 disposed therethrough. The first porthole member 12 further includes an integral tubular member 26 extending outwardly from the back side 20 around the periphery of the opening 22. The Tubular member 26 has a continuous sidewall 28 and extends through the door 16 from the exterior side 14 to an interior side 30 thereof.

The through-door arm access porthole assembly 10 further comprises a second porthole member 32 configured to be securely mounted upon the exterior side 14 of door 16 at an outwardly position from said first porthole member 12. The second porthole member 32 is a rigid plate having a front side 34, a back side 36 and an opening 38 disposed therethrough.

The through-door arm access porthole assembly 10 further comprises a seal member 40 having a front side 44, a rear side 46 and resilient flap members 42. Seal member 40 is disposed and sandwiched between the first porthole member 12 and the second porthole member 32 with the front side 44 contiguous with the rear side 36 of the second porthole member and with the rear side 46 contiguous with the front side 18 of the first porthole member. The resilient flap members 42 are disposed across the openings 22 and 38 of the first porthole member 12 and the second porthole member 32 and are moveable to permit passing an article through the openings, as best seen in FIG. 3. The resilient flap members 42 are triangular shaped and have vertexes 48 which generally movably meet along an axis of the openings 22 and 38 to close the openings therethrough.

The through-door arm access porthole assembly 10 is fastened together and secured to the door 16 by fasteners 50. The through-door arm access porthole assembly 10 is secured to the door 16 with the tubular member 26 extending through the door from the exterior side 14 to the interior side 30, thereof, with the back side 20 of the first porthole member 12 contiguous with the exterior side 14 of the door 16, the back side of the seal member 40 contiguous with the front side 18 of the first porthole member 12, with the front side 44 of the seal member contiguous with the back side 36 of the second porthole member 36 and with the front side 34 of the first porthole member facing outwardly.

As to a further discussion of the manner of usage and operation of the present invention, the same should be apparent from the above description. Accordingly, no further discussion relating to the manner of usage and operation will be provided.

A number of embodiments of the present invention have been described. Nevertheless, it will be understood that various modifications may be made without departing from the spirit and scope of the invention. Accordingly, other embodiments are within the scope of the following claims.

What is claimed is:

1. A through-door arm access porthole assembly, comprising:

a first porthole member of a rigid plate and having a front side, a back side, an opening disposed therethrough, and a non-telescoping unitary tubular portion aligned with said opening and extending from said back side of said first porthole member;

a second porthole member of a rigid plate having a front side, a back side, and an opening disposed therethrough;

a seal member having a plurality of resilient flap members; and said first porthole member, said seal member, and said second porthole member fastened together and attached to an exterior side of a door with said tubular member extending completely through the door from the exterior side to an opposite interior side, with said opening of said first porthole member and said opening of said second porthole member aligned, with said seal member disposed across said openings of said first and second porthole members, and with said seal member and said second porthole member disposed outwardly from and not within the door.

2. The assembly of claim 1, wherein said seal member is disposed and sandwiched between said first porthole member and said second porthole member.

3. The assembly of claim 2, wherein said seal member has a front side contiguous with said back side of said second porthole member, and further wherein said seal member has a back side continuous with said front side of said first porthole member.

4. The assembly of claim 3, wherein said resilient flap members are triangular-shaped and have vertexes which generally movably meet along an axis of said openings of said first porthole member and said second porthole member to close said openings therethrough.

5. The assembly of claim 1, wherein said tubular portion has a continuous sidewall.

6. The assembly of claim 1, wherein:

said back side of said first porthole member is contiguous with the exterior side of the door;

a rear side of said seal member is contiguous with said front side of said first porthole member and a front side of said seal member is contiguous with said back side of said second porthole member; and said front side of said second porthole member faces outwardly.

* * * * *